United States Patent [19]

Nohira

[11] 4,094,287

[45] June 13, 1978

[54] EXHAUST GAS RECIRCULATION SYSTEM

[75] Inventor: Hidetaka Nohira, Susono, Japan

[73] Assignee: Toyota Jidosha Kogyo Kabushiki Kaisha, Toyota, Japan

[21] Appl. No.: 750,141

[22] Filed: Dec. 13, 1976

[30] Foreign Application Priority Data

Sep. 7, 1976 Japan ..... 51-106212

[51] Int. Cl.[2] ..... F02M 25/06

[52] U.S. Cl. ..... 123/119 A; 123/117 A

[58] Field of Search ..... 123/119 A, 117 A, 198 R, 123/103 R

[56] References Cited

U.S. PATENT DOCUMENTS

| | | | |
|---|---|---|---|
| 3,796,049 | 3/1974 | Hayashi | 123/119 A |
| 3,881,456 | 5/1975 | Nohira | 123/119 A |
| 3,924,589 | 12/1975 | Nohira et al. | 123/119 A |
| 3,962,868 | 6/1976 | Matumoto | 123/119 A |
| 3,999,737 | 12/1976 | Hashiguchi | 123/119 A |
| 4,002,154 | 1/1977 | Kestner | 123/119 A |
| 4,033,308 | 7/1977 | Hayashi | 123/119 A |
| 4,041,914 | 8/1977 | Sugihara | 123/119 A |
| 4,048,968 | 9/1977 | Aoyama | 123/119 A |

FOREIGN PATENT DOCUMENTS

| | | | |
|---|---|---|---|
| 2,400,029 | 7/1974 | Germany | 123/119 A |
| 2,417,001 | 12/1974 | Germany | 123/119 A |

*Primary Examiner*—Wendell E. Burns

*Attorney, Agent, or Firm*—Stevens, Davis, Miller & Mosher

[57] ABSTRACT

An exhaust gas recirculation system (EGR system) with an EGR valve means for controlling the amount of the exhaust gas to be recirculated into an intake system in an internal combustion engine, said EGR valve means comprising an intake system vacuum operated valve means for controlling the amount of the recirculated exhaust gas and a vacuum pump operated valve means for additionally controlling the amount of the recirculated exhaust gas. The EGR system preferably further comprises means for stopping EGR operations when not required and means for adjusting a required ignition timing.

7 Claims, 3 Drawing Figures

EXHAUST GAS RECIRCULATION SYSTEM

This invention relates to a system for recirculating exhaust gases in an internal-combustion engine.

As means for reducing exhaust gases from an engine, especially $NO_x$ contained therein, there has been proposed a method in which a part of an exhaust gas is recirculated in the suction system to increase the amount of an inert gas and to lower the combustion temperature of a gas-fuel mixture. By the term "inert gas" used herein is meant a gas other than air to be mixed with a fuel. Namely, the inert gas includes residual gas left in a combustion chamber and recirculated exhaust gas. This exhaust gas recirculating method has a considerable effect in reducing $NO_x$ in automobile engines. Accordingly, this method is practically worked on a broad basis in this field. In this exhaust gas recirculation (hereinafter referred to as ("EGR") system, various methods are adopted for controlling the amount of exhaust gas to be recirculated, but what is broadly adopted in the art is a so-called proportional EGR method in which the amount of recirculated exhaust gas is controlled in proportion to the amount of suction or introduced air.

Referring to ordinary automobile gasoline engines, in a case wherein the exhaust gas is not recirculated (in this case, the proportion of the inert gas is equal to the proportional of the residual gas in the combustion chamber), the proportion of the inert gas in the cylinder is reduced because the pressure in the intake pipe is high, namely, the load is high. In an engine having such a characteristic, even when the exhaust gas is recirculated in proportion to the amount of suction air, only the proportion of the inert gas as a whole is increased. Therefore, it has been found that the characteristic curve is not substantially changed. Accordingly, the proportion of the inert gas decreases as the load is high. Therefore, if the engine is operated under such characteristic conditions, the $NO_x$ concentration in the exhaust gas increases as the load is high, because the proportion of the inert gas decreases as the load is high, and hence, the effect of reducing $NO_x$ is lowered. More specifically, the amount of $NO_x$ formed in the combustion chamber is substantially influenced by the proportion of the inert gas present in the combustion chamber, and the above characteristic inherent to the proportional amount of the EGR is not preferred for the reduction of the formation of $NO_x$ when the load is high, because the proportion of the inert gas decreases at a high load. In contrast, when the load is low, the proportion of the inert gas increases and the effect of reducing $NO_x$ is enhanced. However, a too large a proportion of the inert gas results in the wasteful use of fuel and in an increase of the fuel expenses. Accordingly, it is not permissible to increase the proportion of the inert gas without limitations. Therefore, what proportion of the inert gas should be adopted in response to the load has heretofore been determined in view of the regulated standard value of the exhaust gas and after due consideration of the fuel expenses, the power and other factors influencing the engine performance. In the conventional proportional EGR system, since the proportion of the inert gas changes depending on the load, as pointed out hereinabove, it is impossible to set the proportion of the inert gas, regardless of the load. This is an important problem involved in the conventional proportional EGR system.

In our co-pending U.S. application (Ser. No. 654,176, filed on Feb. 2, 1976), there has been proposed an EGR system in which recirculation of the exhaust gas is performed under such conditions that the proportion of the inert gas is not influenced by the load and the inert gas is present in a proportion substantially constant to the suction air. Under the above conditions, the chemical properties of a gas-fuel mixture can always be kept substantially constant and unchanged. Since combustion conditions are principally identical, substantially the same $NO_x$ concentration could always be obtained. Therefore, it will be possible to maintain the $NO_x$ concentration below the predetermined value regardless of operational conditions.

As the EGR systems now adopted in the art, there can be mentioned the "Above the Throttle Blade Entry EGR System", in which the exhaust gas is recirculated above a throttle valve, and the "Below the Throttle Blade Entry EGR" or "Manifold Entry EGR System", in which the exhaust gas is recirculated below a throttle valve or to an intake manifold.

Therefore, in the above-mentioned US application, the two EGR systems most preferred for performing EGR while making the proportional amount of an inert gas constant to the amount of suction air (strictly, the sum of the amount of suction air and the amount of the inert gas) were logically discussed, and preferred embodiments having constructions for varying the rate of the amount of the recirculated exhaust gas with regard to the intake air in accordance with the intake manifold vacuum, i.e., the engine load, were disclosed.

However, in the EGR system provided in the US application, since the EGR control valve means operates in response to the intake manifold vacuum, the valve portion of the EGR control valve means is closed by a spring force resulting in the stopping of the EGR operation when the engine load is nearly at full load, that is, when the intake manifold vacuum is nearly at atmospheric pressure. This results in a reduction of the effect of decreasing the $NO_x$.

It is therefore a primary object of this invention to provide an EGR system in which EGR could be performed even during a full engine load.

Another object of the present invention is to control the ignition timing in the engine in accordance with the operational or the non-operational position of the EGR control valve, in view of the fact that the ignition timing required when EGR is being performed is different from that required when no EGR is being performed.

In the above-mentioned U.S. application, the EGR system comprises a construction for automatically adjusting the cross-sectional area of the valve port of the EGR control valve means through which the recirculated exhaust gas passes, as a function of an intake manifold vacuum or an engine load. The present invention basically comprises a construction such as that mentioned above.

In the detailed description of the preferred embodiments of the invention presented below, reference is made to the accompanying drawings, in which:

FIG. 1 illustrates an embodiment wherein this invention is applied to the "Above Throttle Blade Entry EGR System".

Figure 1:
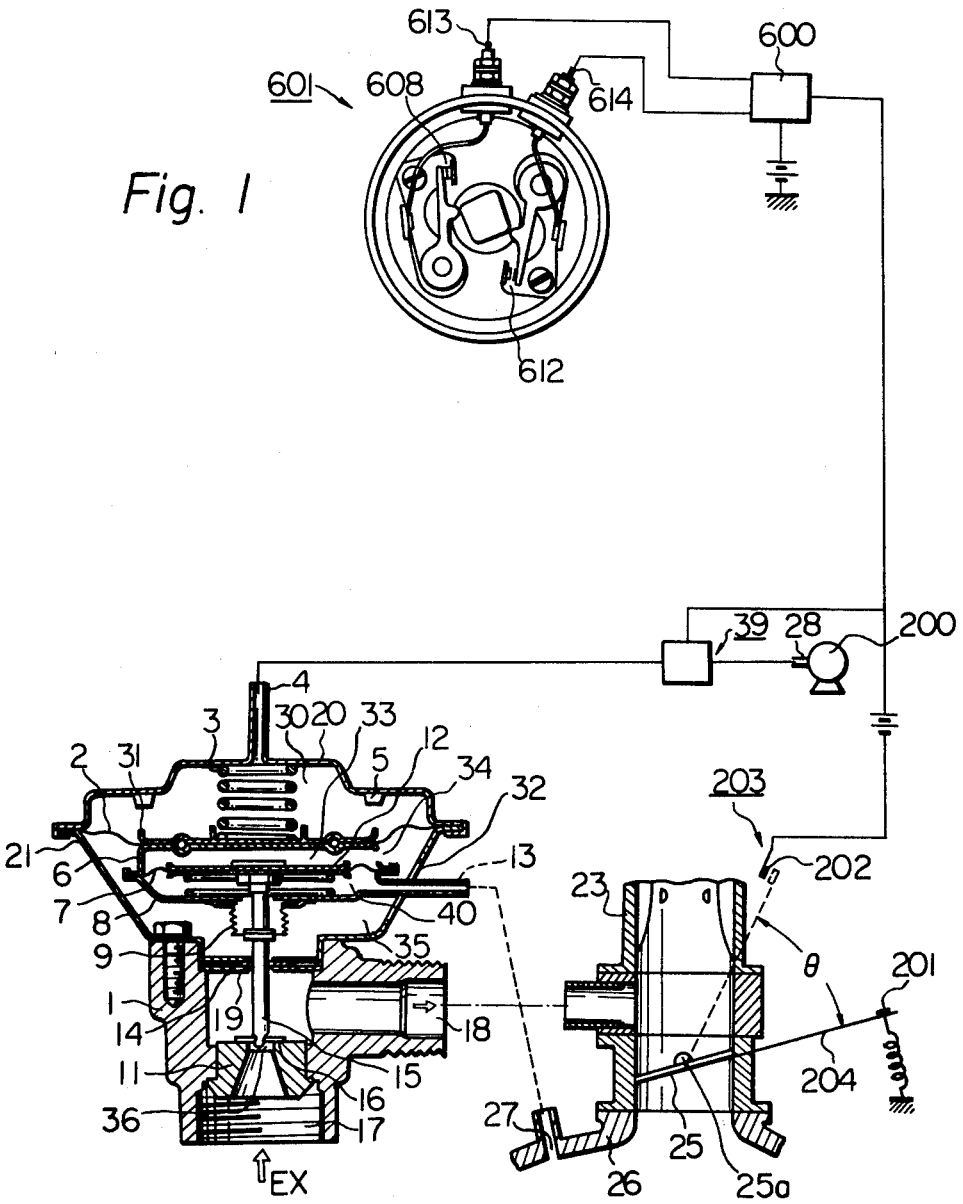
FIG. 1 shows a first embodiment of the EGR system according to the present invention.

An EGR valve means is provided with two overlapping diaphragm operation mechanisms. A valve box 1 has an EGR gas inlet 17 for recirculating an exhaust gas coming from an exhaust system EX (FIG. 1) and an EGR gas outlet 18 for recirculating the exhaust gas to above a throttle valve 25 of a carburetor 23. A frame of a diaphragm operation chamber proper formed by a diaphragm casing 21 and a casing lid 20 is fixed on the valve box 1. The interior of this operation chamber proper is isolated from an exhaust gas passage in the valve box 1 by a seal plate 14 and a heat insulating plate 19, so that it is not influenced by the high temperature exhaust gas. A first diaphragm 2 is air-tightly spread between the casing lid 20 and the diaphragm casing 21. The first diaphragm 2 is always urged downwardly by a first spring 3 through a retainer 31 fixed to the first diaphragm 2. A stopper 5 for the retainer 31 is disposed to control the quantity of upward deviation of the first diaphragm 2. A pressure plate 6 is fixed to the lower face of the first diaphragm 2, and the pressure plate 6 is engaged with a second diaphragm case 8. A second diaphragm 7 is spread between the plate 6 and the case 8. Both overlapping first diaphragm chamber 30 (vacuum operation chamber) and second diaphragm chamber 40 (vacuum operation chamber) are sealed chambers. The first diaphragm chamber 30 is connected through a sensing connecting pipe 4 to an engine-driven or an electrically-driven vacuum pump 200, and the second diaphragm chamber 40 is connected via a sensing connecting pipe 13 to a port 27 opened into the intake pipe or manifold 26. A second open chamber 33 above the second diaphragm 7 is connected to a first open chamber 35 formed in the diaphragm casing 21 through an opening 34 formed on the pressure plate 6. These chambers are always opened to the open air through an opening 32 formed on the diaphragm casing 21.

The second diaphragm 7 is always urged upwardly in the figure by a secondspring 12 stronger than the first spring 3. A valve stem 15 is fixed to the second diaphragm 7 so that it moves in the vertical direction together with the second diaphragm. A bellows 9 is disposed to allow the valve stem 15 to move while keeping air-tightness within the second diaphragm operation chamber 40. The valve stem 15 penetrates through the seal plate 14 and the heat insulating plate 19, and the valve stem 15 has an EGR valve 16 at the lower end thereof. A valve opening 36 is formed by an orifice former 11 which acts as a valve seat of the ERG valve 16. A port 28 is opened into the vacuum pump 200 to serve as a vacuum port, and a port 27 is opened at a suitable part downstream of a throttle valve 25, for example, in an intake manifold 26.

When the vacuum in the sensing connecting pipe 4 reaches, for example, 60 mm Hg, the vacuum lifts up the first diaphragm 2 to the uppermost position against the first spring 3, where the retainer 31 is engaged with the stopper 5, and hence, the valve stem 15 is lifted up to the uppermost position and the EGR valve 16 is moved to the full opening position. Accordingly, under automobile driving conditions that is, when the vacuum pump 200 is in operation, the EGR valve reaches the full opening position where the valve stem 15 is at the uppermost position.

The vacuum of the intake manifold 26 influences on the second diaphragm 7 through the port 27, and hence, the second diaphragm 7 is downwardly stretched against the second spring 12. As a result, the valve stem 15 which has been kept at the uppermost position by the upward pulling force of the first diaphragm 2 is returned downwardly by the second diaphragm 7, so that the valve stem occupies an intermediate position between the uppermost position (the valve full opening position) and the lowermost position (the valve full closing position). Since the first diaphragm 2 compresses the weak first spring 3 and is deviated to the uppermost position where the retainer 31 is engaged with the stopper 5, with an increase of the vacuum the valve stem 15 is downwardly deviated by the action of the second diaphragm 7 to narrow the flow passage area of the valve opening, and hence, the amount of the exhaust gas passing through this opening is decreased.

In the sensing connecting pipe 4 connecting the first diaphragm chamber 30 to the vacuum pump 200 is arranged a controller 39 which controls the operation of exhaust gas recirculation and which may, for example, be an electromagnetic valve means. The controller 39 operates in response to a signal from a throttle opening switch means 203. The switch means 203 comprises a stationary contact 202 fixed at a position in which the throttle valve 25 opens by a $\theta$ degree, and a movable contact 201 mounted to a support arm 204 which is fixed to the shaft 25*a* of the throttle valve 25 and is movable therewith. Consequently, when the throttle valve 25 rotates by $\theta$ degree, the movable contact 201 contacts with the stationary contact 202, resulting in the operation of the controller 39 to shut off communication between the first diaphragm chamber 30 and the vacuum pump 200 so as to prevent the vacuum from the pump 200 from acting upon the first chamber 30, thereby closing the EGR control valve means. That is, it is possible for the controller 39 to perform EGR only when required and to stop EGR when not required, such as when the throttle valve 25 opens more than $\theta$ degree and the vehicle speed is, for example, above 100 [km/h], by shutting off the vacuum-communication between the first diaphragm chamber 30 and the port 28 of the vacuum pump 200. Disconnection of the sensing connecting pipe 4 causes a downward displacement of the first diaphragm 2 by the force of the first spring 3. In addition, since the intake manifold vacuum is acting on the second diaphragm chamber 40 and urging the second diaphragm 7 downward, the valve stem 15 is then caused to occupy its lowermost position in which the EGR valve is fully closed and no EGR is performed.

Since the vacuum pump 200 can be driven, for example by the engine and accordingly, always produces a vacuum above a predetermined value during the driving of the vehicle. The vacuum acts on the first diaphragm chamber 30 except only when the controller 39 is closed, resulting in that the EGR valve means is in an open position even when the intake manifold vacuum is near atmospheric pressure i.e., when the engine is in a full load condition, thereby decreasing the $NO_x$ concentration. This decrease can be achieved by the provision of a first diaphragm chamber 30 of the EGR control valve means, connected to the vacuum pump 200.

In the above-mentioned U.S. application, the first diaphragm chamber corresponding to the first chamber 30 of this invention is connected to a port opened into the carburetor at the vicinity of the throttle valve; therefore, no intake manifold vacuum acts upon the first diaphragm chamber when the intake manifold vacuum is near atmospheric pressure, thus causing the above-mentioned disadvantages to occur.

The embodiment of FIG. 1 can perform a recirculation of the exhaust gas while keeping the proportion of the inert gas in the cylinder substantially constant, in a manner similar to that described in the U.S. application. However, a decrease in the $NO_x$ concentration does not always require that a proportion of the inert gas be kept substantially constant. Further such a decrease can also be sufficiently expected by controlling the amount of EGR in accordance with the engine load to control the proportion of the inert gas in the cylinder. That is to say, as is explained in the U.S. application, in order to keep the proportion of the inert gas constant, the amount of EGR must be increased as the intake manifold vacuum becomes smaller and, accordingly, as the engine load becomes higher. However, it is also possible to keep the amount of EGR substantially constant when the intake manifold vacuum is within the scope of a predetermined level. This can be easily performed by properly selecting the spring constant of the second spring 12.

According to the present invention, the throttle opening switch means 203 is connected to an ignition timing adjuster 601 which is per se known. The ignition timing adjuster 601 may be for example, in the form of a two-point distributor as disclosed in detail in U.S. Pat. No. 3,718,126. The stationary contact 202 is connected by a lead through a relay means 600 to leads 613 and 614 which are connected to contact breakers 608 and 612, respectively. The relay means 600 selectively connects the stationary contact 202 to the lead 613 or the lead 614 for adjusting the ignition timing. The two-point distributor is per se known; therefore, its construction and operation can be omitted herein.

Alternatively, as an ignition timing adjuster, a double-diaphragm operated distributor having two diaphragms, with diverse operational characteristics can be applied. In the latter case, an electromagnetic valve means selectively operates the operational vacuum circuits of the two diaphragms. Thus, the provision of the throttle opening switch means 203 makes it possible to vary the ignition timing required when EGR is being performed from the ignition timing required when no EGR is being performed. It will be understood that the ignition timing can be adjusted in the above-explained way, since the ignition timing required when EGR is being performed is usually and preferably advanced in comparison with the ignition timing required when no EGR is being performed in order to obtain a favorable combustion and to improve the consumption of fuel.

Figure 2:
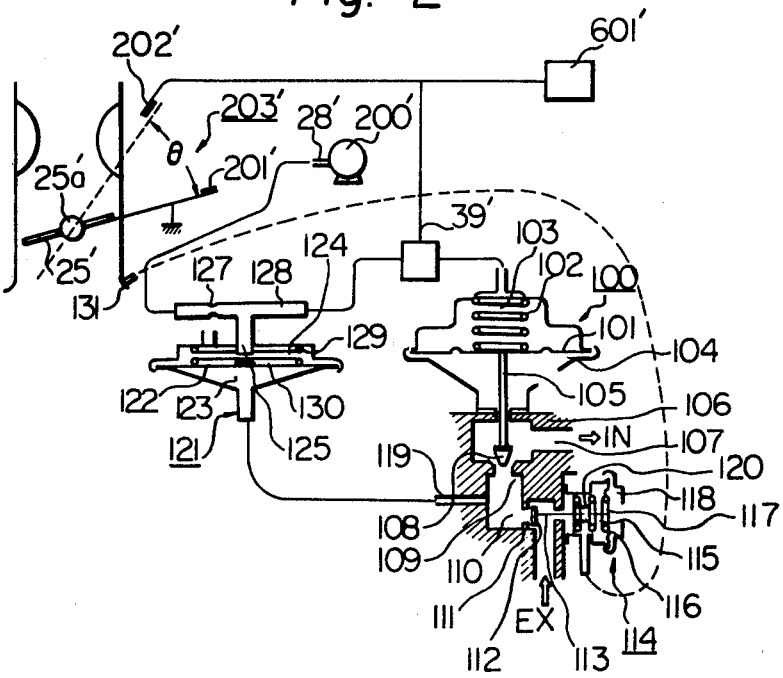
FIG. 2 shows a second embodiment thereof, and, FIG. 3 shows a characteristic curve of the $NO_x$ concentration wherein the technique of the present invention and the conventional technique are compared with each other.

FIG. 2 illustrates an embodiment showing this invention being applied to the "Below the Throttle Blade Entry EGR System".

The EGR valve means comprises a first control valve means 100 and a second control valve means 114. This first control valve means per se is known in the art. A diaphragm chamber 103 of the first control valve means 100 is connected through a regulator 121 to a vacuum port 28' of an engine-driven or an electrically-driven vacuum pump 200'. The other chamber 104 of the first control valve means 100 is an atmospheric pressure chamber opened to the open air. A valve stem 105 is fixed to a diaphragm 101 which moves in the vertical directions of the Figure to open and close a valve 108. With opening of the valve 108, an exhaust gas is recirculated from an exhaust gas system EX (not shown) through an EGR gas inlet, a restriction 111, a constant pressure chamber 110 and the valve 108 to below the throttle valve of the carburetor or to the intake manifold, as indicated by an arrow in the Figure.

The regulator 121 is known per se, and has two chambers 124 and 123 partitioned by a diaphragm 122. The chamber 124 forms an atmospheric pressure chamber opened to the open air and the other diaphragm chamber 123 is connected to the lower constant pressure chamber 110 of the first control valve means 100. The diaphragm 122 is always urged downwardly by a spring 129. A stop seat 125 is disposed at the center of the diaphragm 122. This seat 125 performs the function of closing an air bleed nozzle 130 exposed to the chamber 124 when the diaphragm 122 is upwardly deviated. A restriction 127 is provided in a sensing pipe passage 128 connecting the diaphragm chamber 103 of the first control valve means 100 to the vacuum port 28' of the vacuum pump 200'. A controller 39' similar to the controller 39 in FIG. 1 is arranged in a conduit connecting the sensing pipe passage 128 to the diaphragm chamber 103 of the first control valve means 100 to accomplish the same function as that of the controller 39 in FIG. 1.

The second control valve means 114 according to this invention is mounted on a restriction 111 forming the inlet of the lower chamber 110 of the first control valve means 100. This second control valve means 114 corresponds to the second diaphragm device of the embodiment shown in FIG. 1. The second control valve means 114 has two chambers partitioned by a diaphragm 116, one being an atmospheric chamber 118 opened to the open air and the other being a diaphragm chamber 115 connected to a port 131 opened downstream of a throttle valve 25' of the carburetor. The diaphragm 116 is always pressed toward the side of the atmospheric pressure chamber 118 by means of a spring 117. Reference numeral 120 denotes a bellows similar to the bellows 9 shown in FIG. 1.

There is provided, similarly to FIG. 1, a throttle opening switch means 203' comprising a movable contact 201' which is fixed to a shaft 25a' of the throttle valve 25' and movable therewith, and a stationary contact 202' provided at a position in which the throttle valve 25' opens by a $\theta$ degree. The switch means 203' feed signals to the controller 39' and to an ignition timing adjuster 601' to stop the EGR operation when not required, and to control the ignition timing, similarly to that shown in FIG. 1.

The operation of the apparatus shown in FIG. 2 is basically identical with the operation of the apparatus shown in FIG. 1. More specifically, when a vacuum is imposed on the port 28', if the air bleed nozzle 130 is closed by the stop seat 125 mounted on the diaphragm 122, namely if a back pressure is imposed on the diaphragm chamber 123 by the exhaust gas in the lower chamber 110 (of course, at this point the valve 108 of the EGR valve device is closed), then this vacuum port acts on the diaphragm chamber 103 of the first control valve means 100 of the EGR valve device, lifts up the diaphragm 101, and in turn the valve stem 105 is caused to open the valve 108. As a result, the exhaust gas passes through the valve 108 and is recirculated to the intake manifold IN as indicated by an arrow in the Figure. Thus, the pressure of the lower chamber 110 is lowered, and hence, the diaphragm 122 is pushed up to the normal position by the spring 129 to open the air bleed nozzle 130. As a result, the vacuum of the vacuum pump 200' is air-bled and the negative pressure is not transmitted to the diaphragm chamber 103. Accordingly, the diaphragm 101 is pushed down by the spring 102 and the valve 108 is closed. Thus, the pressure in the lower chamber 110 is increased again, and the above-mentioned cycle of operations is repeated. In short, the regulator 121 acts as an automatic adjustment valve as if it were a thermostat in a temperature sensing system.

The operation of the second control valve means 114 is quite similar to that of the diaphragm device having the second diaphragm 7, which is illustrated in FIG. 1. Accordingly, an explanation of the operation of the second control valve means 114 has been omitted.

Also, in the system shown in FIG. 2, a desired EGR can be performed under any load conditions of the engine, regardless of the intake manifold vacuum, while keeping the proportion of the inert gas in the cylinder substantially constant. As similar to the system shown in FIG. 1, a reduction of the $NO_x$ concentration below the prescribed level does not always require that the proportion of the inert gas be kept constant, and, accordingly, it is possible to properly select the spring characteristic of the spring 117.

Figure 3:
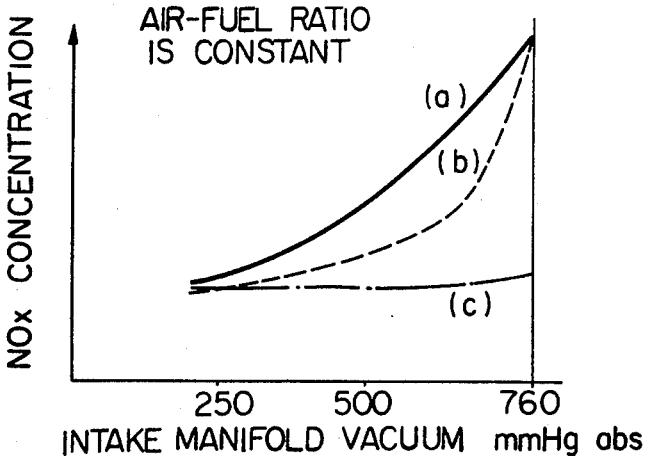

FIG. 3 is a diagram showing the results of experiments conducted by using the apparatus shown in FIG. 1. Curve (*a*) shows results obtained when EGR was not performed; curve (*b*) shows results obtained when proportional EGR was performed according to the conventional technique; and curve (*c*) shows results obtained when EGR was conducted according to the present invention. From the results shown in FIG. 3, it will be readily understood that the concentration of exhausted $NO_x$ is made substantially constant even when the intake manifold vacuum is near atmospheric pressure (760 mm Hg), regardless of the amount of the intake manifold vacuum in the present invention.

As will be understood from the foregoing description, according to the present invention, since recirculation of the exhaust gas can be performed while keeping the proportion of the inert gas in the cylinder substantially constant, the present invention can overcome troubles and disadvantages involved in the conventional proportional EGR system, which are caused by an increase in the proportion of the inert gas in the cylinder in the low load operation region and by a decrease in said proportion in the high load operation region, such as unstable combustion and reduction of the $NO_x$ removing effect in the high load operation region. In other words, according to the present invention, a certain correcting function by the intake manifold vacuum is newly added and by this function, the proportion of the inert gas in the cylinder can be kept substantially constant, whereby the $NO_x$ concentration can be effectively reduced. Furthermore, since the proportion of the inert gas in the cylinder can be kept constant, chemical conditions for combustion are in turn kept constant; hence, simplification of the control of, for example, ignition timing can be attained conveniently. Thus, it is made possible to manufacture an engine capable of always reducing the $NO_x$ concentration below a prescribed level with the foregoing various advantages.

Further, it is also possible in a practical design to sufficiently satisfy the restriction requirement of the $NO_x$ concentration by selecting the second spring 12 in FIG. 1 or the spring 117 in FIG. 2 having the proper characteristics, although, the proportion of the inert gas is not being kept constant.

In addition, the throttle opening switch means 203 or 203' are switched "ON" by fully stepping on an acceleration pedal when engine power is required; the EGR operation is stopped to make it possible to shift from a regular driving condition to a high power driving condition; and to corresponding adjust the ignition timing.

What is claimed is:

1. An improved exhaust gas recirculation system for recirculating exhaust gases to an intake system through exhaust gas recirculating valve means operated in response to a vacuum in the intake system in an internal combustion engine, wherein the improvement comprises an intake system vacuum operated valve means which controls the amount of the exhaust gases to be recirculated therethrough in response to the intake system vacuum and a vacuum pump operated valve means which additionally controls the amount of the exhaust gas controlled by said first mentioned valve means in response to a vacuum of an engine-driven or an electrically-driven vacuum pump which always produces a vacuum above a predetermined value during the driving of the vehicle.

2. An exhaust gas recirculation system for recirculating exhaust gases to the upstream area of throttle valve means provided in a carburetor forming a part of an intake system through exhaust gas recirculating valve means operated in response to a vacuum of the intake system in an internal combustion engine, said system comprising exhaust gas recirculating valve means provided with two overlapped diaphragm operation mechanisms one of which is provided with a valve body means for controlling the amount of the exhaust gases to be recirculated therethrough, and is operated in response to the intake system vacuum the other diaphragm operation mechanism being connected to and operated in response to a vacuum of an engine-driven or an electrically-driven vacuum pump which always produces a vacuum above a predetermined valve during the driving of the vehicle, to additionally control said valve body means of the first mentioned diaphragm operation mechanism.

3. An exhaust gas recirculation system as set forth in claim 2, wherein said system further comprises a controller arranged between said other diaphragm operation mechanism and the vacuum pump to shut off the action of the vacuum from the vacuum pump on the diaphragm operation mechanism, and a throttle opening switch means which operates in response to the movement of the throttle valve means of the carburetor to control said controller.

4. An exhaust gas recirculation system as set forth in claim 3, wherein said system further comprises an ignition timing adjuster connected to and operated by said throttle opening switch means to adjust a required ignition timing.

5. An exhaust gas recirculation system for recirculating exhaust gases to the downstream area of throttle valve means provided in a carburetor forming a part of an intake system through exhaust gas recirculating valve means operated in response to a vacuum of the intake system in an internal combustion engine, said system comprising an exhaust gas recirculating valve means which is operated in response to a vacuum of the intake system and is provided with a valve body means for controlling the amount of the exhaust gases to be recirculated therethrough, a valve means for additionally controlling the amount of the exhaust gas to be recirculated, which is operable independent of said exhaust gas recirculating valve means in response to a vacuum of an engine-driven or an electrically-driven vacuum pump connected thereto, the vacuum pump always producing a vacuum above a predetermined value during the driving of the vehicle, and a diaphragm operation type regulator arranged in a line connecting the vacuum pump operated valve means and the vacuum pump to air-bleed the line.

6. An exhaust gas recirculation system as set forth in claim 5, wherein said system further comprises a controller arranged between said vacuum pump operated valve means and said regulator to shut off the action of the vacuum from the vacuum pump on the vacuum pump operated valve means, and a throttle opening switch means which operates in response to the movement of the throttle valve means of the carburetor to control said controller.

7. An exhaust gas recirculation system as set forth in claim 6, wherein said system further comprises an ignition timing adjuster connected to and operated by said throttle opening switch means to adjust a required ignition timing.

* * * * *